US007510206B2

(12) United States Patent
Walker

(10) Patent No.: US 7,510,206 B2
(45) Date of Patent: Mar. 31, 2009

(54) SNOW SKATES

(76) Inventor: Curtis G. Walker, 5505 Cliffridge Place, North Vancouver, B.C. (CA) V7R 4S2

( * ) Notice: Subject to any disclaimer, the term of this patent is extended or adjusted under 35 U.S.C. 154(b) by 0 days.

(21) Appl. No.: 10/514,101

(22) PCT Filed: May 12, 2003

(86) PCT No.: PCT/CA03/00696

§ 371 (c)(1),
(2), (4) Date: Aug. 19, 2005

(87) PCT Pub. No.: WO03/095040

PCT Pub. Date: Nov. 20, 2003

(65) Prior Publication Data

US 2006/0097484 A1 May 11, 2006

(30) Foreign Application Priority Data

May 10, 2002 (CA) ..... 2 385 832

(51) Int. Cl.
*A63C 5/00* (2006.01)
*A63C 5/04* (2006.01)

(52) U.S. Cl. ..... 280/600; 280/601; 280/608; 280/609

(58) Field of Classification Search ..... 280/600, 280/601, 608, 609
See application file for complete search history.

(56) References Cited

U.S. PATENT DOCUMENTS

| | | | | |
|---|---|---|---|---|
| 1,802,116 | A | 4/1931 | Kinsley | |
| 1,886,650 | A * | 11/1932 | Willard et al. | 280/600 |
| 3,295,859 | A | 1/1967 | Perry | 280/11.13 |
| 4,004,355 | A * | 1/1977 | Koblick | 36/122 |
| 4,083,577 | A * | 4/1978 | Ford | 280/609 |
| 4,188,046 | A | 2/1980 | Fleckenstein | 280/618 |
| 4,433,855 | A * | 2/1984 | Wyke | 280/609 |
| 4,705,291 | A * | 11/1987 | Gauer | 280/609 |
| 4,836,571 | A * | 6/1989 | Corbisiero | 280/600 |
| 5,193,839 | A * | 3/1993 | Hannes | 280/600 |
| 5,871,224 | A * | 2/1999 | Vance | 280/608 |
| 6,352,268 | B1 * | 3/2002 | Peart | 280/14.21 |
| 2002/0017771 | A1 * | 2/2002 | McManus et al. | 280/600 |
| 2006/0097484 | A1 * | 5/2006 | Walker | 280/600 |

FOREIGN PATENT DOCUMENTS

| | | |
|---|---|---|
| DE | 3139119 A1 | 4/1983 |
| EP | 1050324 B1 | 11/2000 |
| FR | 1071142 | 8/1954 |
| FR | 1368152 | 7/1964 |
| FR | 2623724 A1 | 6/1989 |
| JP | 2005-525181 (T) | 8/2005 |
| WO | 9119549 | 12/1991 |

* cited by examiner

*Primary Examiner*—Paul N Dickinson
*Assistant Examiner*—John R Olszewski
(74) *Attorney, Agent, or Firm*—Seed IP Law Group PLLC

(57) ABSTRACT

A snow skate is disclosed which provides improved control and skate-like performance, particularly on hard-pack or icy surfaces. The snow skate has edges which increasingly project from the central flat region of the ski to the forward area. Preferably this is achieved by making the base increasingly concave forward and rearward from a central generally flat region.

22 Claims, 19 Drawing Sheets

SNOW SKATES

BACKGROUND OF THE INVENTION

1. Field of the Invention

The invention relates to the field of equipment for descending snow-covered slopes, and more particularly to the design and construction of snow skates.

2. Description of the Related Art

Conventional snow skis have a length typically greater than 1 meter. Short skis from 60 to 100 cm. referred to as "skiboards", SNOW-BLADES™ or Big Foot™ skis are popular as a novelty for skiers who wish to retain the skiing experience but with a more easily maneuverable ski. They tend to be difficult to control in hard or icy conditions. As well, skiboards are unstable at speed when ridden flat due to their sidecut. Further, they do not attempt to emulate the performance of ice skates which allow a user to both track a straight line or arcs of varying radii, turn and stop sharply or accelerate on a hard surface.

Many attempts have been made at designing snow skates which are not much longer than the user's foot. U.S. Pat. No. 1,802,116 to Kinsley discloses a snow skate having a length comparable to a roller skate for use on snow or ice and having a runner with beaded edges and a central guide. On snow the skate runs on the full lower surface of the runner while on ice it rides on the beaded edges. French patent no. 1,071,142 issued Mar. 3, 1954 to Henrich discloses a ski from 50 to 65 cm. in length for use on ice-fields, glaciers and the like and having downwardly projecting metal edges extending along either edge thereof. U.S. Pat. No. 3,295,859 to Perry discloses a metal ski of about 91.5 cm. in length having grooves along the bottom of either lateral edge. U.S. Pat. No. 4,188,046 to Fleckenstein discloses a plastic ski of about 51 cm. in length with a flat base and no metal edges for use in trick skiing. U.S. Pat. No. 4,705,291 to Gauer discloses a short ski of about 80 cm. in length in which the base is substantially convex from front to rear and from side to side for ease of pivoting and spinning.

One problem with prior snow skates is that they do not provide adequate control for the skier on hard or icy surfaces as well as soft surfaces. There is therefore a need for a pair of snow skates which has good handling characteristics on such surfaces and can combine the performance characteristics of ice skates on hard surfaces with the performance of skis on soft snowy surfaces of varying inclination.

BRIEF SUMMARY OF THE INVENTION

The invention therefore provides a snow skate, having an elongated ski body having an upturned front end and a rear end, one embodiment of the snow skate comprising: a) an upper surface adapted to receive a boot binding for releasably securing a boot to the upper surface intermediate said front and rear ends; b) a base surface having a central, generally flat zone and a zone of increased edge projection forward of the flat zone; and c) longitudinal edges extending along opposed sides of said base surface; wherein the depth of said edges below said base increases continuously from said flat zone towards said zone of increased edge projection.

In particular embodiments, the base surface further comprises a second zone of increased edge projection rearward of the flat zone and the depth of the edge elements below the base increases continuously from the flat zone towards the second zone of increased edge projection.

According to another embodiment of the invention, there is provided a snow skate, having an elongated ski body having an upturned front end and a rear end, the ski body in this embodiment comprising: a) an upper surface adapted to receive a boot binding for releasably securing a boot to the upper surface intermediate the front and rear ends; b) a base surface having a central, generally flat zone and a zone of increased edge projection forward of the flat zone; and c) longitudinal edges extending along opposed sides of the base surface; wherein the transverse concavity of the base increases continuously from the flat zone towards the zone of increased edge projection.

In particular embodiments, the base surface further comprises a second zone of increased edge projection rearward of the flat zone and the transverse concavity of the base increases continuously from the flat zone towards the second zone of increased edge projection.

The edges can be rockered over the length of the snow skate.

BRIEF DESCRIPTION OF THE SEVERAL VIEWS OF THE DRAWINGS

In drawings, which illustrate selected embodiments of the invention.

DETAILED DESCRIPTION OF THE INVENTION

Throughout the following description, specific details are set forth in order to provide a more thorough understanding of the invention. However, the invention may be practiced without all of these particulars. In other instances, well known elements have not been shown or described in detail to avoid unnecessarily obscuring the invention. Accordingly, the specification and drawings are to be regarded in an illustrative, rather than a restrictive, sense.

Figure 1:
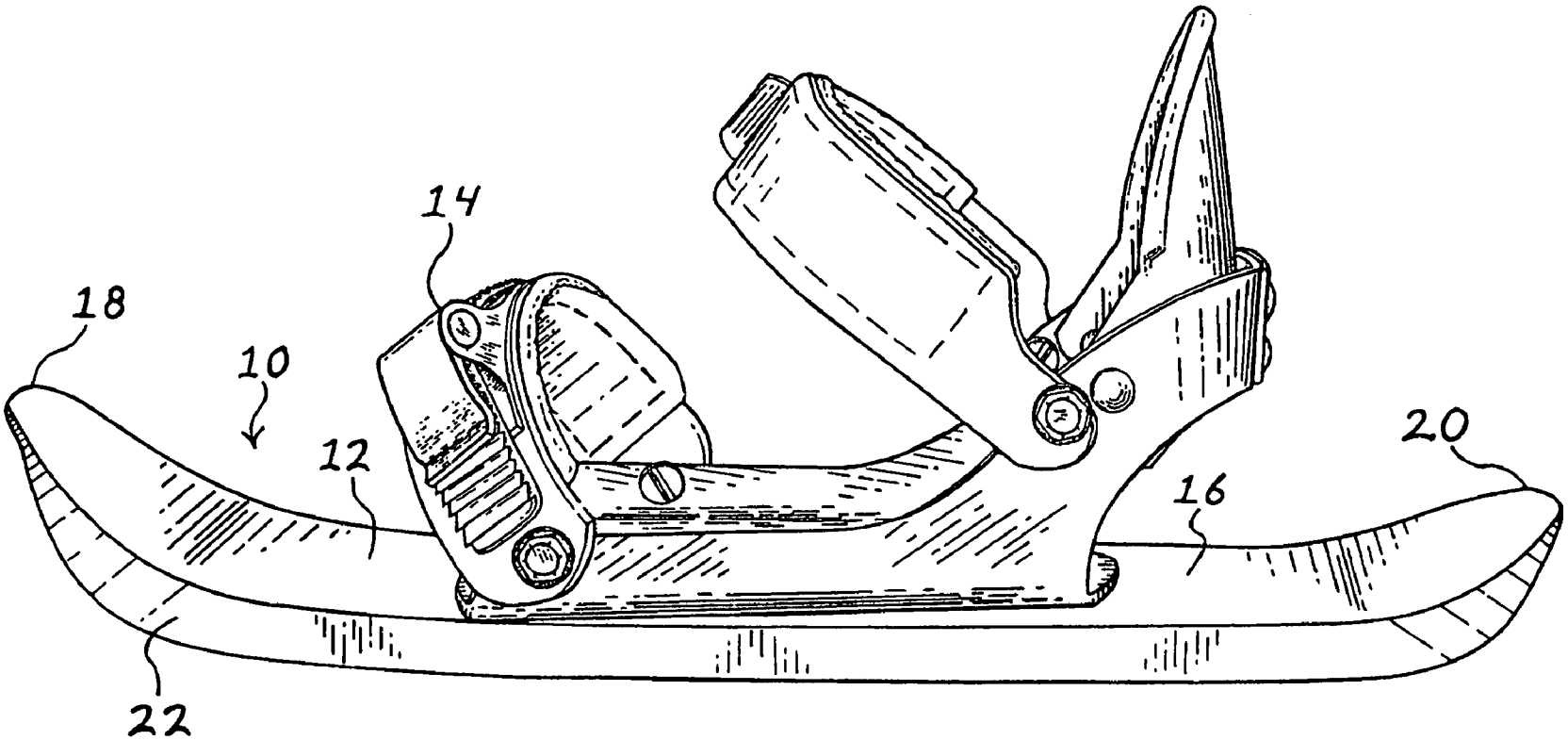
FIG. 1 is a perspective view of a snow skate according to one embodiment of the invention.

FIG. 1 illustrates one embodiment of a snow skate 10 according to the invention. The snow skates 10 are used in pairs, in which the right and left skates can be identical. Each snow skate 10 can be symmetrical about its central longitudinal axis. The illustrated snow skate 10 comprises a ski 12 and a boot binding 14 which is secured to the upper surface 16 of ski 12 by screws or other fasteners in the usual way. Preferably two rows of standard snowboard binding 6 mm stainless steel threaded "T"-nut inserts 28, (FIG. 5) which mate with the binding's mounting bolts, spaced 4 cm apart are used. Ski 12 has a forward upturned shovel or tip 18 and rear upturned tip 20, the forward tip being preferably somewhat higher than the rear tip. The upturned rear tip 20 permits the ski 10 to go backwards, but need not be upturned if backwards motion is not required. The ski 12 may have generally vertical side walls 22 while upper surface 16 is generally flat. The length of ski 12 is somewhat (a few inches generally) longer than the user's boot at either end, preferably from about 36 to 51 cm. (14 to 20 inches) with a maximum length of approximately 25 inches. It is preferably about 13 to 18 cm. (5 to 7 inches) in width so that standard snowboard bindings do not extend beyond the side walls 22. Ski 12 can be slightly narrower for use with ski boots; and a smaller (range from 20-41 cm/8-16" long), narrower (~10 cm/4" wide) model for children can be provided. Preferably ski 12 has a slight rocker or reverse camber of the edges from front to rear as described below in regard to FIG. 4.

Figure 2:
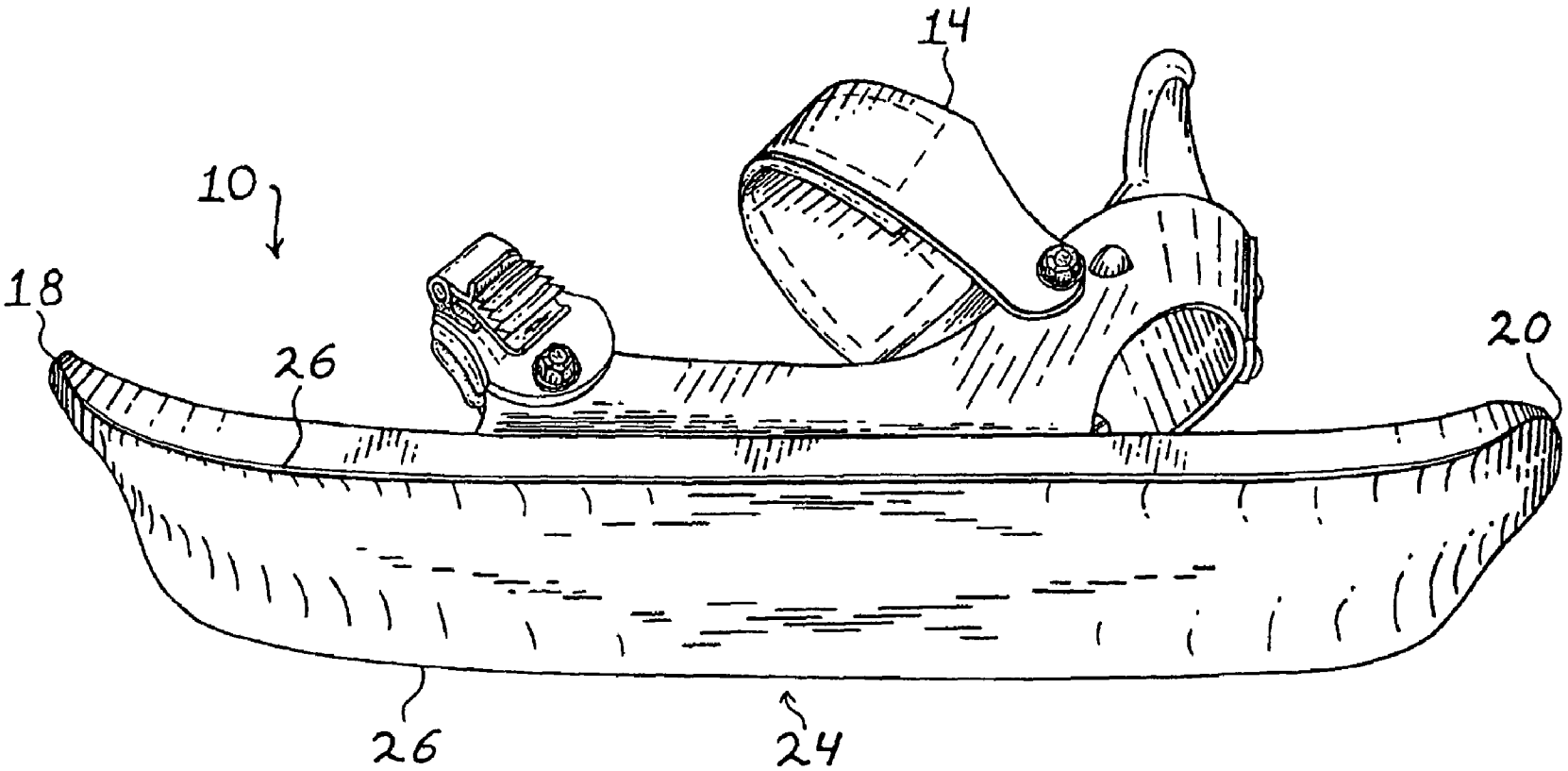
FIG. 2 is a perspective view from below of the snow skate of FIG. 1
Figure 3:
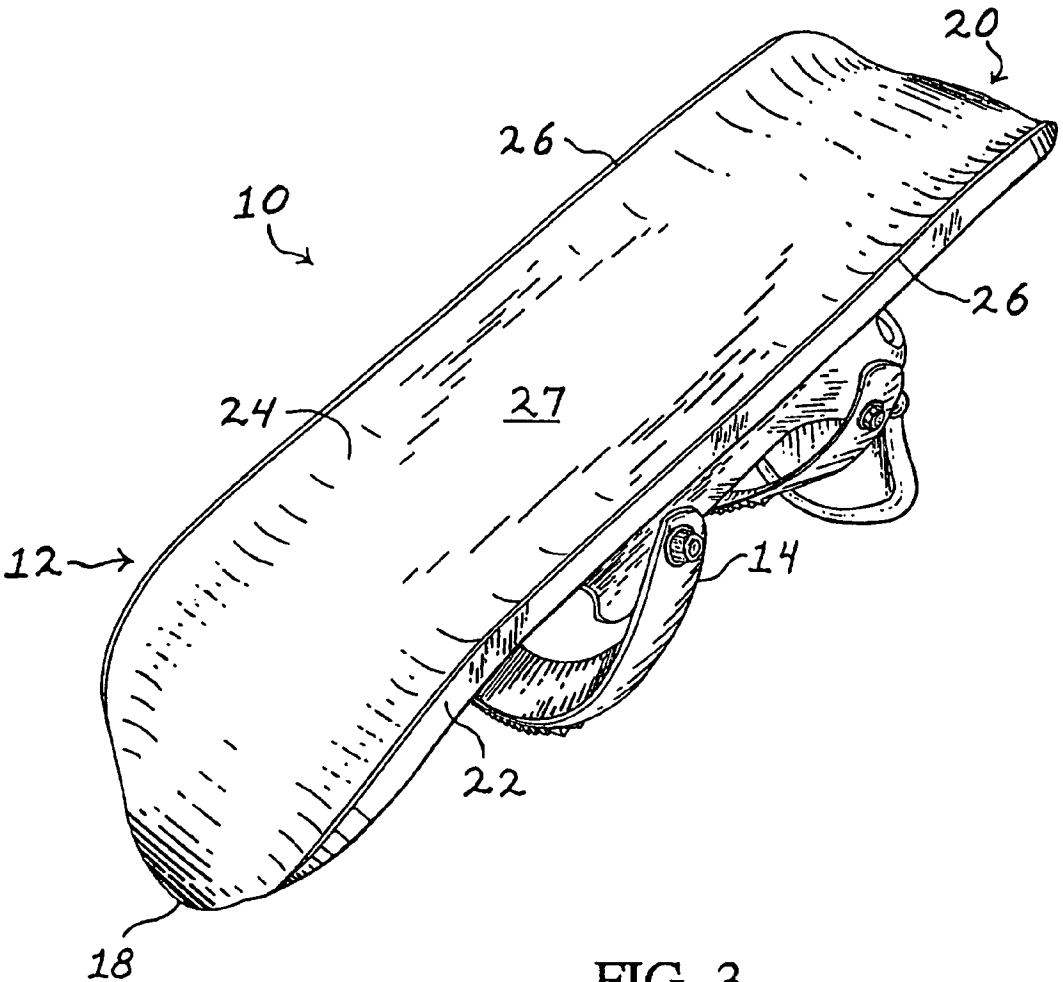
FIG. 3 is a lower perspective view of the snow skate of FIG. 1.

FIGS. 2 and 3 illustrate the features of the base 24 of ski 12. Base 24 preferably has generally parallel metal side edges 26. The edges 26 may converge slightly toward the midline as they upturn at the front and rear ends 18, 20. The edges 26 can be standard steel edges having tabs or holes or other means to fasten or bond them to the construction layers of the ski 10. The edges 26 can be mounted vertically rather than horizontally into the reinforcing fiber cloth/epoxy matrix during construction to allow a narrow edge apex to be developed. Carbon steel edges are preferred but other hard metal or synthetic substances which are capable of being sharpened and holding an edge may also be suitable. Base 24 preferably has a smoothly varying contour which is generally concave in relation to the edges 26. Most importantly, as described in more detail below, the degree of concavity of base 24 is least in the central part of the base 24 and increases toward either end 18, 20 and most significantly towards the front end 18. Base 24 may have a central convexity 27 or other central feature to assist in tracking in snow and to assist in bearing the weight of the user to reduce drag from excessive edge penetration. Other profiles as illustrated in FIG. 14 through 19 are also possible to improve straight line tracking, such as longitudinal grooves, troughs, steps or beads in or on the base surface.

Figure 4:
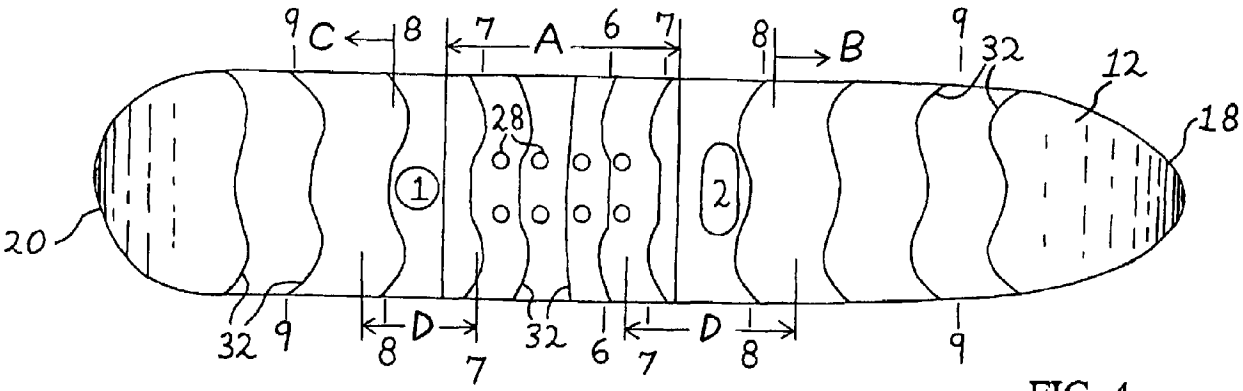
FIG. 4 is a top plan view of the snow skate of FIG. 1 with lines indicating the cross-sectional contour of the base at various intervals.
Figure 5:
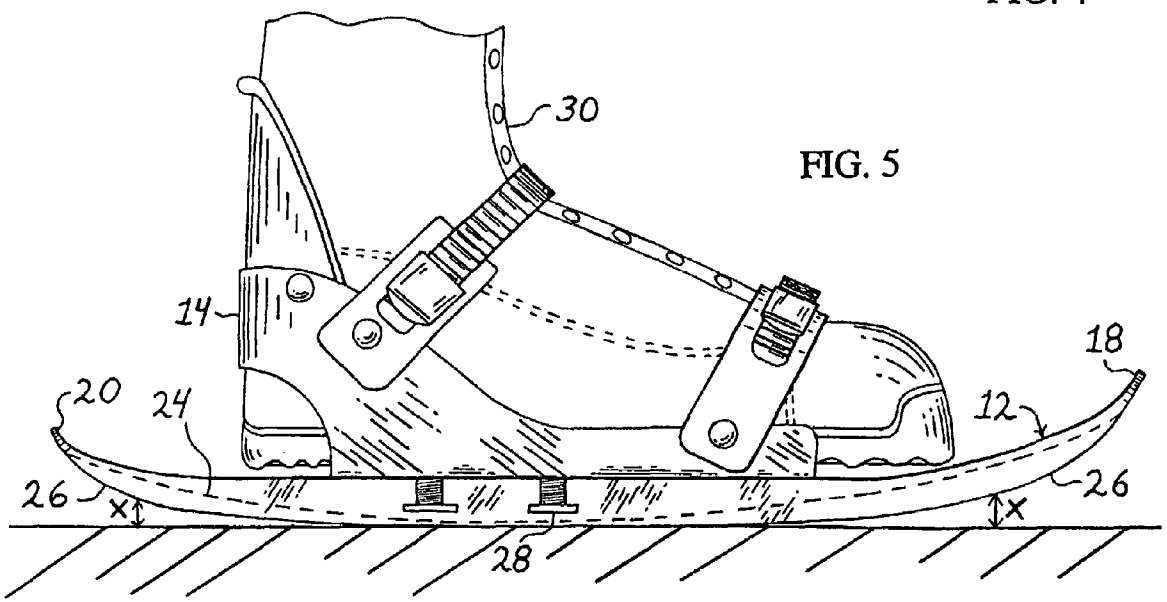
FIG. 5 is a side view of the snow skate of FIG. 1 with a boot mounted thereon and the ski shown in longitudinal cross-section, with the degree of rocker exaggerated for purposes of illustration.

With reference to FIG. 4 and 5, a boot 30 is shown mounted in binding 14. The binding 14 is located so that the heel of the user's foot (designated by the encircled "1") lies centered approximately in zone C in FIG. 4 and the ball of the user's foot (designated by the encircled "2") lies centered approximately in zone B in FIG. 4. As illustrated in FIG. 5, the base 24 (shown in dotted outline) and edges 26 of ski 12 have a slight rocker or reverse camber to allow the ski to sideslip or slide lip or skid obliquely without biting when the ski is weighted over the flat zone A, due to the clearance X shown in FIG. 5. The edges 26 may be flat over length of the flat zone (as shown in FIG. 5 and described below), and then begin a slight upward curvature at the point of the ball and heel of the foot towards the front and rear. The slight rocker ahead and behind the foot arch in combination with the increasing concavity of the base 24 creates a pronounced curvature of the base surface longitudinally which assists in carving a turn in snow when the skis 12 are leaned over at speed. The slight rocker of the snow skates' 10 base edges 26 also allows the snow skater to use slight shifts in his center of gravity/balance point to concentrate his weight preferentially over the central flat zone A of the snow skates, or more towards the "bite zone" B in a smooth transition, as desired. By having a slight rocker, the contact surface of the base 24 and edges 26 ahead of and behind any given bearing point of the sliding surface is lifted just clear of a hard, icy surface, and the user is able to employ the varying tracking and holding characteristics of particular areas of the snow skates' 10 bases on a snow-covered slope.

Figure 6:
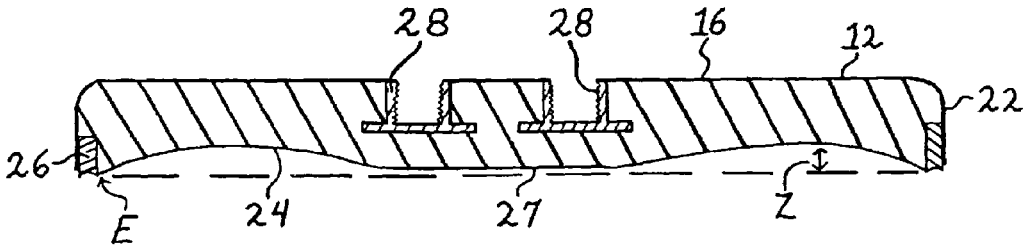
FIG. 6 is a cross-section viewed along lines 6-6 of FIG. 4.
Figure 7:
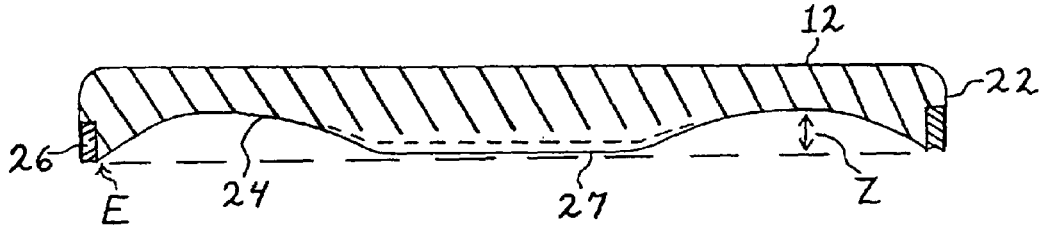
FIG. 7 is a cross-section viewed along lines 7-7 of FIG. 4.
Figure 8:
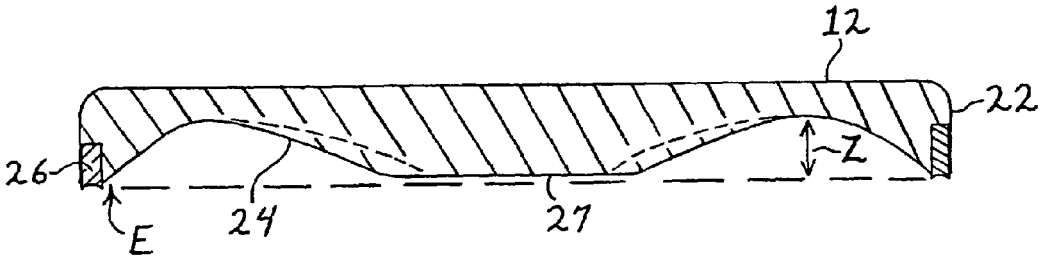
FIG. 8 is a cross-section viewed along lines 8-8 of FIG. 4.
Figure 9:
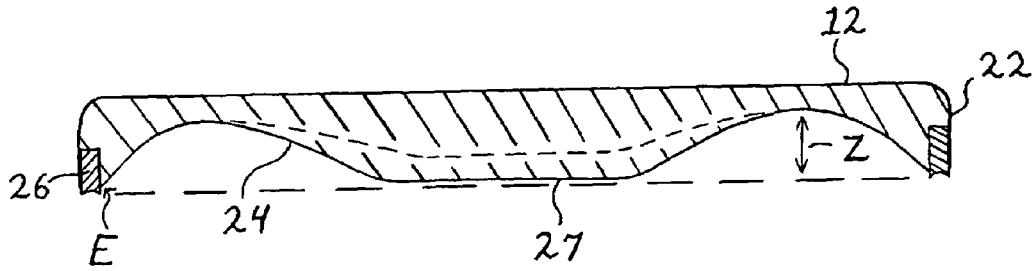
FIG. 9 is a cross-section viewed along lines 9-9 of FIG. 4.

Contour lines 32 in FIG. 4 illustrate that the concavity of the base 24 is least in a central flat zone A and greatest towards either end in front and rear bite zones B and C, and is in transition between minimum and maximum concavity in transition zones D. Increasing concavity develops with increasing upturn of the base and edges although the front and rear tips 18, 20 are preferably flat in cross-section. FIG. 6 shows the cross-section near the center of the flat zone of the preferred embodiment. Preferably there is a slight concavity side to side even in center of the flat zone A, with edges 26 extending to a slightly greater depth than base 24, so that only edges 26 contact a hard icy surface in the central zone A. FIG. 7 shows the cross-section at the edge of the flat zone A bordering on the transition zone D. FIG. 8 shows the cross-section where the transition zone D overlaps the bite zone B and FIG. 9 shows the cross-section at the maximum concavity and resulting bite in the bite zone. As illustrated, the concavity of the base 24, that is, the depth of the edges 26 in relation to the base increases continuously towards either end of the base. In the embodiment shown in FIGS. 6-9, the slope of the region E of the base 24 adjacent edge 26, relative to the horizontal, increases from less than 25 or 30 degrees, and preferably less than 10 degrees, in the central region of the flat zone A to more than 45 degrees and preferably more than 60 degrees in the bite zone B (FIG. 4). Preferably the rear bite zone C has a lesser degree of bite than the forward zone B, with an angle of slope E for example up to 45 degrees. At the same time, the edges 26 in flat zone A may project slightly vertically from the plane of base 24 (see FIG. 22B). Similarly the depth Z of the concave areas of the base 24, relative to the plane of the edges 26, increases from the flat zone A to the bite zone B. Depth Z in FIG. 6 may be about 3/16 inches, increasing to ½ inch in FIG. 9. The range of depth Z in the flat zone A may be from 0 to ½ inch, and in bite zone B may be from ⅜ inches to 1.5 inches. The dotted lines in FIGS. 7-9 also show three variations on how the degree of concavity can be increased in the forward direction.

Figure 10A:
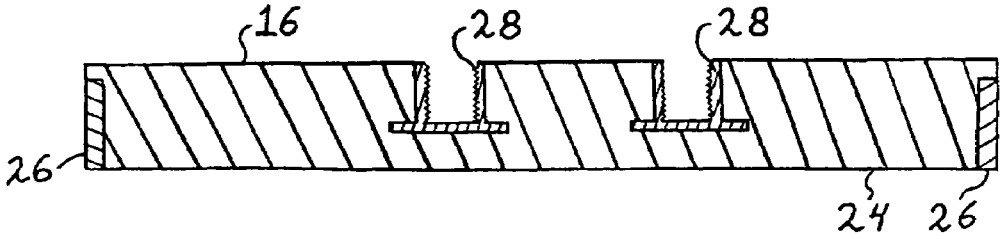
FIGS. 10A-10C are cross-sections of an alternate embodiment of the invention.
Figure 10B:
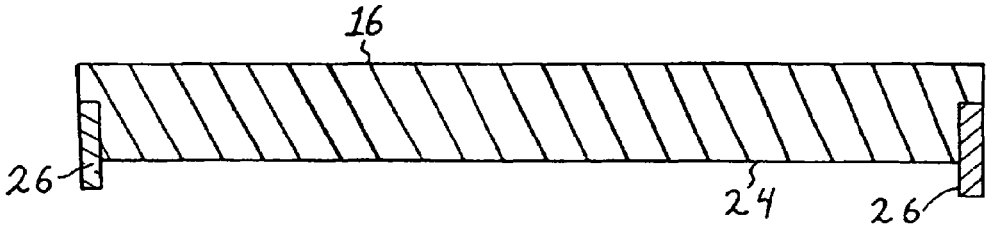
Figure 10C:
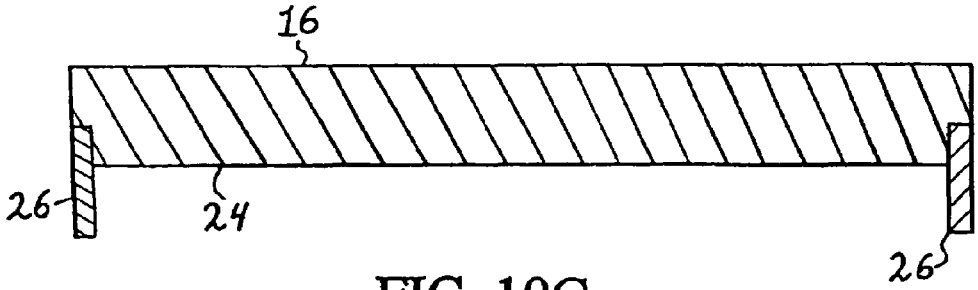

In its simplest embodiment, as shown in FIGS. 10A-10C, the base 24 can be flat rather than curved or contoured. FIG. 10A is a cross-section through the center of the flat zone A as along lines 6-6 of FIG. 4. FIG. 10B is a cross-section through the transition zone D as along lines 8-8 of FIG. 4 showing increasing projection or depth of edges 26. FIG. 10C is a cross-section through the bite zone B,C as along lines 9-9 of FIG. 4 showing maximum projection or depth of edges 26.

Figure 11A:
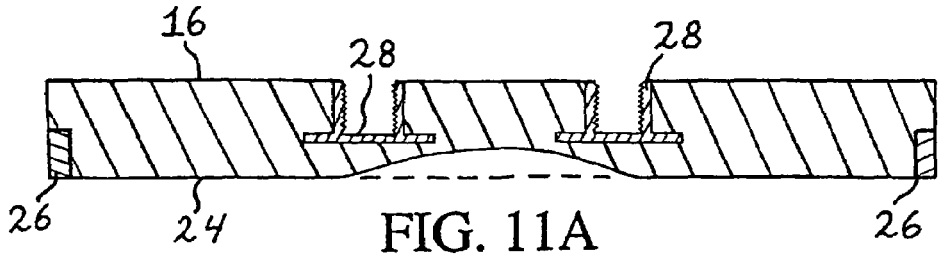
FIGS. 11A-11E are cross-sections of another alternate embodiment of the invention.
Figure 11B:
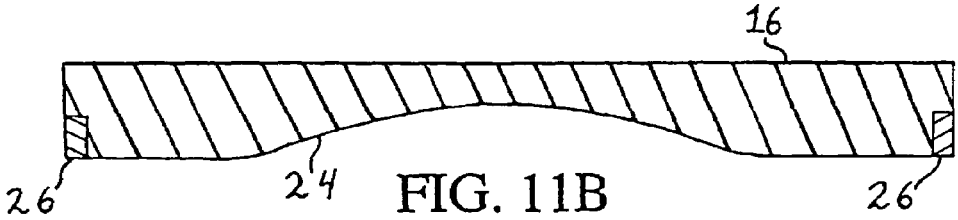
Figure 11C:
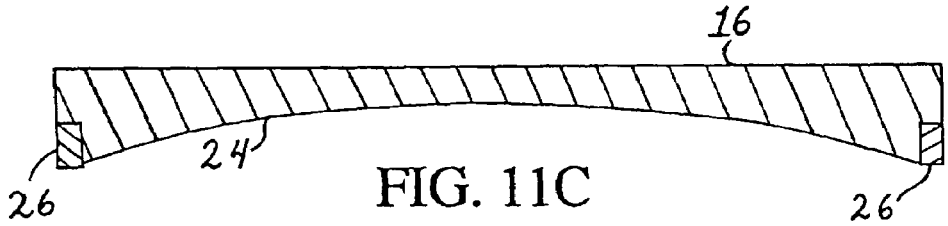
Figure 11D:
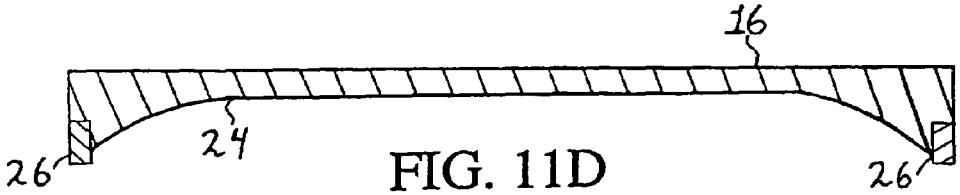
Figure 11E:
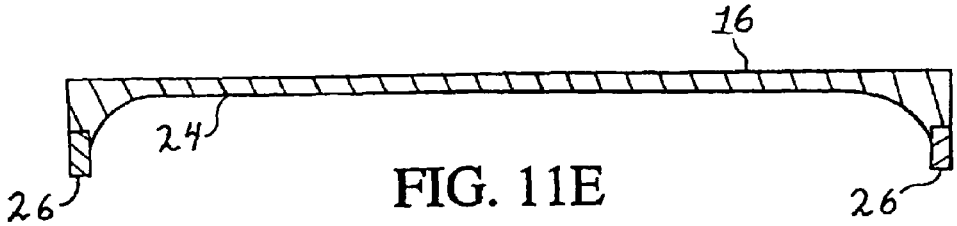

In a further embodiment, as shown in FIGS. 11A-11E, the base 24 can have a simple curvature which provides a smoother transition from the base 24 to the edges 26 than that shown in FIG. 10. FIG. 11A is a cross-section through the center of the flat zone A as along lines 6-6 of FIG. 4. FIGS. 11B, 11C and 11D are cross-sections through the transition zone D showing increasing projection or depth of edges 26. FIG. 11E is a cross-section through the bite zone B,C as along lines 9-9 of FIG. 4 showing maximum projection or depth of edges 26 and maximum development of transverse concavity.

Figure 12A:
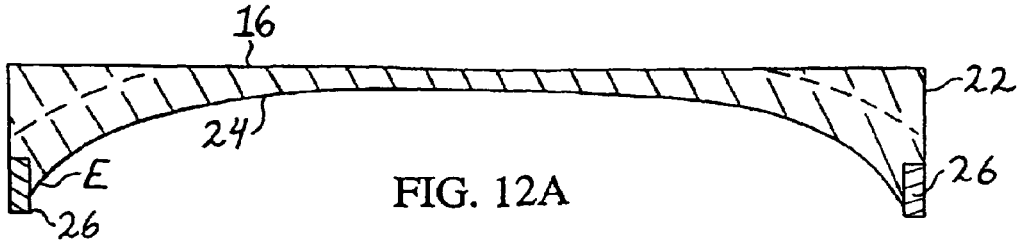
FIGS. 12A-12F are cross-sections of still another alternate embodiment of the invention.
Figure 12B:
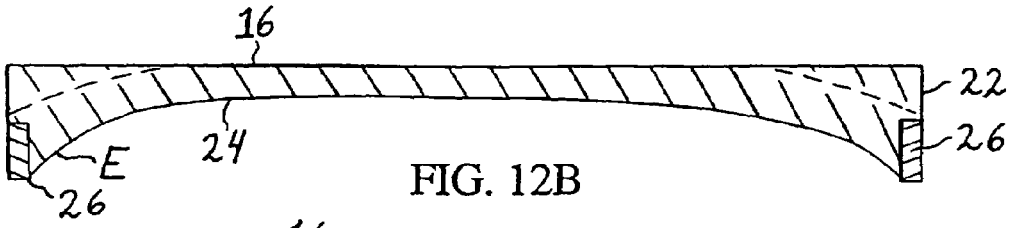
Figure 12C:
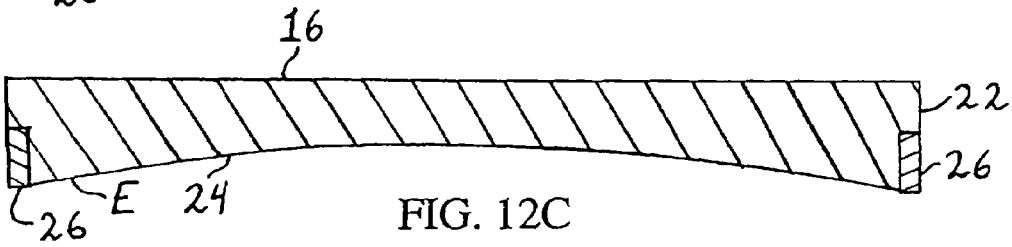
Figure 12D:
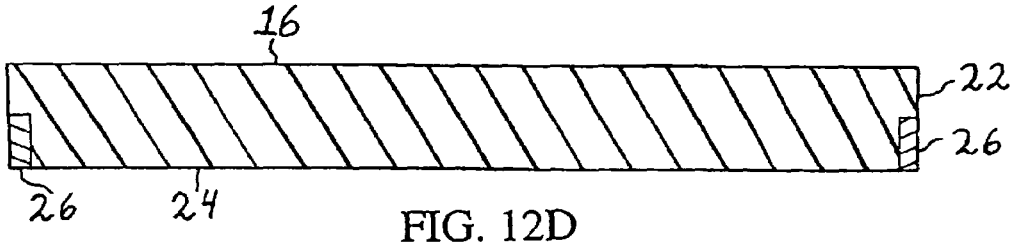
Figure 12E:
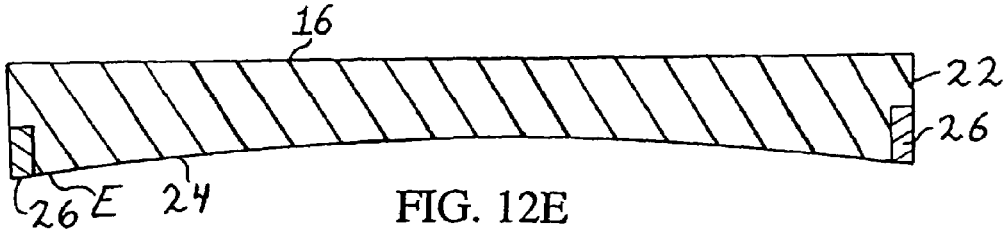
Figure 12F:
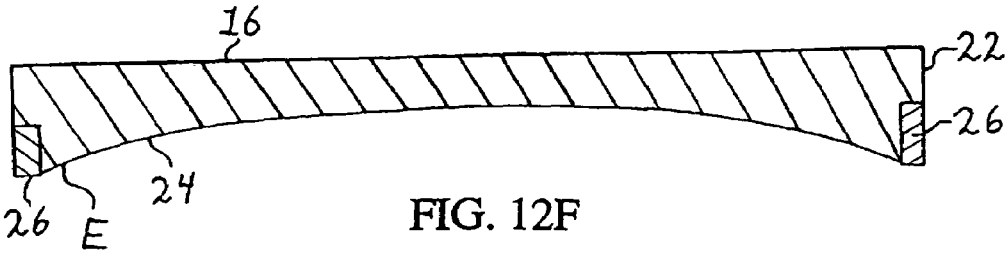

In a further embodiment, as shown in FIGS. 12A-12F, the base 24 can have a simple curvature similar to that shown in FIG. 11, which provides a smoother transition from the base 24 to the edges 26 than the embodiment shown in FIG. 10, and wherein the forward transverse concavity and forward projection or depth of the edges is greater than in the rear bite zone C. FIG. 12D is a cross-section through the center of the flat zone A as along lines 6-6 of FIG. 4. FIGS. 12B and 12C are cross-sections through the forward transition zone D showing increasing angle of slope E and projection or depth of edges 26. FIG. 12A is a cross-section through the forward bite zone B as along rightmost lines 9-9 of FIG. 4 showing maximum projection or depth of edges 26. FIG. 12E is a cross-section through the rear transition zone D showing relatively lesser increasing projection or depth of edges 26 and lesser increasing concavity than the forward bite zone B. FIG. 12F is a cross-section through the rear bite zone C as along leftmost lines 9-9 of FIG. 4.

Figure 13A:
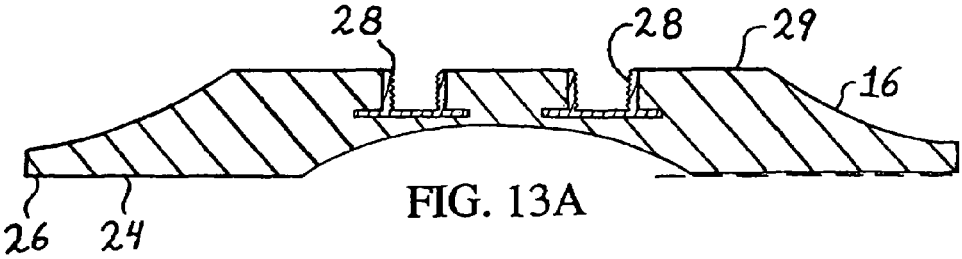
FIGS. 13A-13F are cross-sections of yet another alternate embodiment of the invention.
Figure 13B:
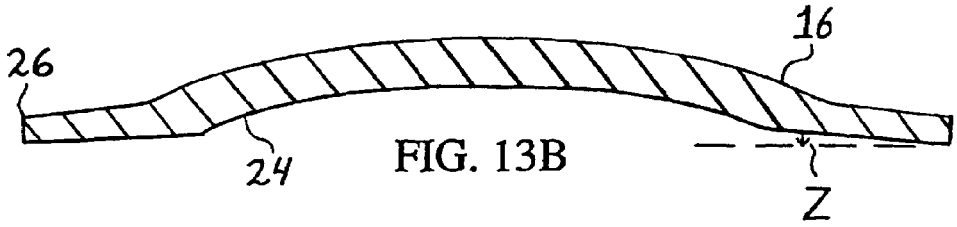
Figure 13C:
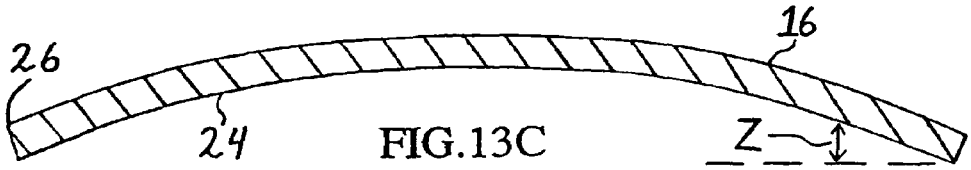
Figure 13D:
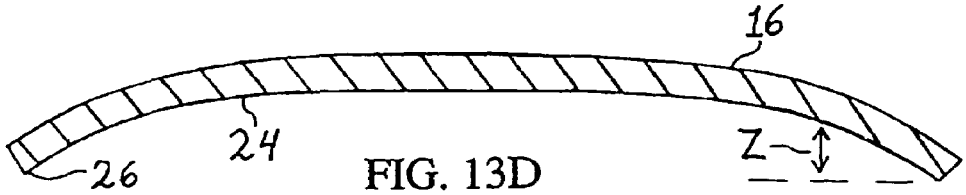
Figure 13E:
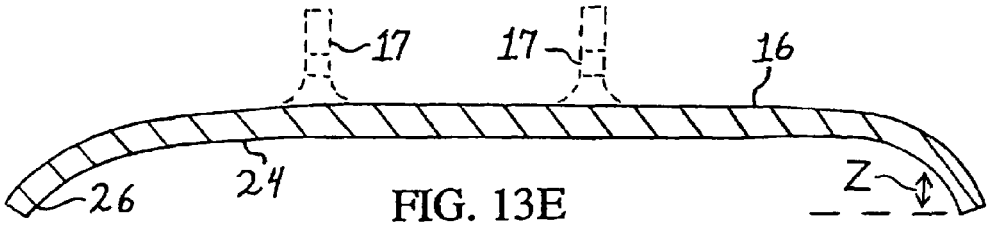
Figure 13F:
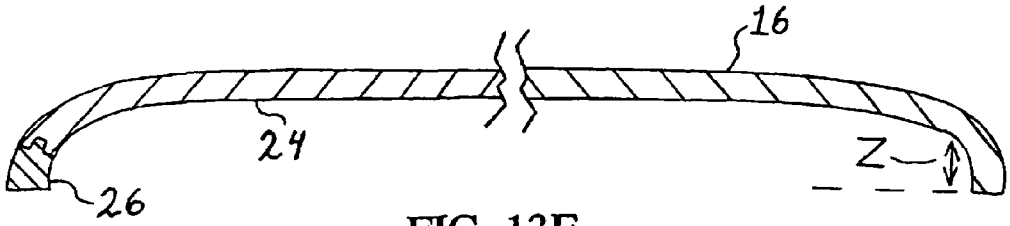

In a further embodiment, as shown in FIGS. 13A-13F, the edges 26 can follow the increasing curvature of base 24. FIG. 13A is a cross-section through the center of the flat zone A as along lines 6-6 of FIG. 4, with a flat portion 29 to receive the binding 14. FIGS. 13B-13E are cross-sections through the transition zone D showing increasing concavity and projection or depth of edges 26 due to increased deflection and curvature of base 24. FIG. 13E is a cross-section through the bite zone B,C as along lines 9-9 of FIG. 4 showing maximum concavity and projection or depth of edges 26. Alternatively, the increasing exposure of the edges 26 compared to the base 24 can be achieved by increasing the angle of the edges from the horizontal, while the edges remain aligned with the base, either with edges which are straight or curved in cross-section. For example the area in slope E could have an increasing curvature in cross-section towards the bite zone. FIGS. 13A-13E also show an embodiment where the edges 26 are formed from the same material as the body of the ski 12, such as injected molded plastic. FIG. 13F shows a steel edge insert 26. FIG. 13E shows raised flanges 17 which could be provided to receive a boot binding other than a standard snowboard binding.

While the invention will work also if the increase in concavity, projection or depth of the edges or effective "bite" of the base is only present forward of the central flat zone, it is preferred to have this increase in base concavity, projection or depth of the edges in both forward and rearward directions. This avoids a tendency to pivot and generally provides better tracking and greater control for the user.

Figure 14A:
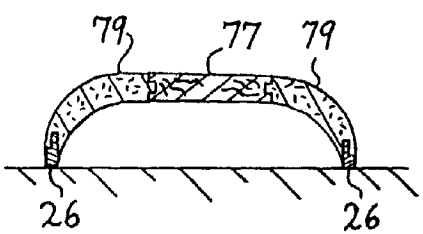
FIGS. 14-22 are bottom views and cross-sections of alternate embodiments of the invention.
Figure 14B:
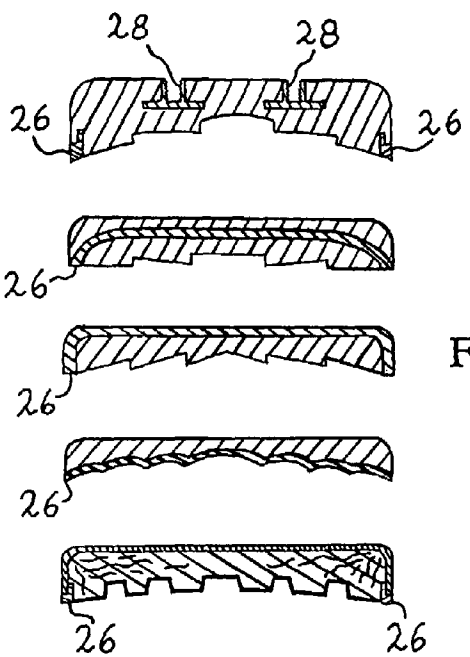
Figure 14:
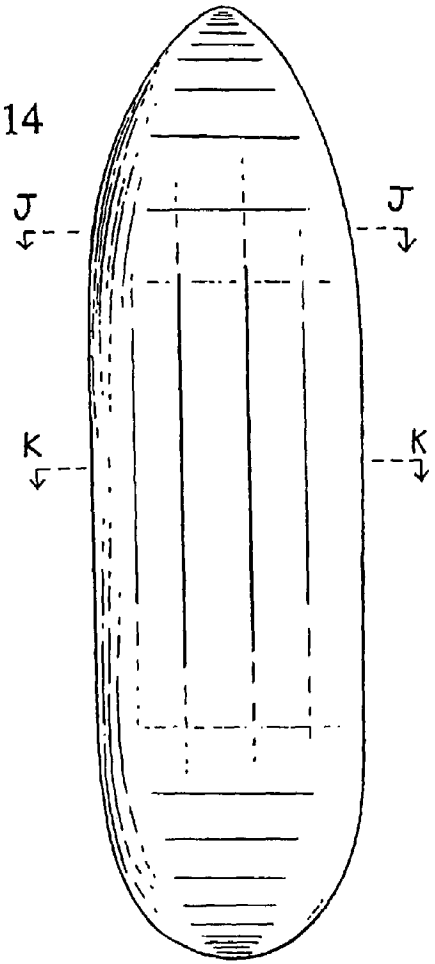
Figure 15A:
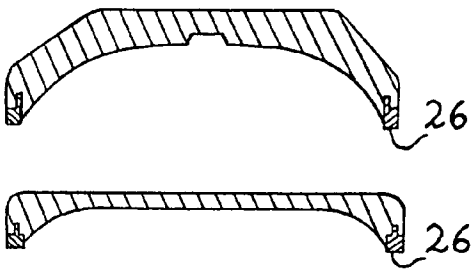
Figure 15B:
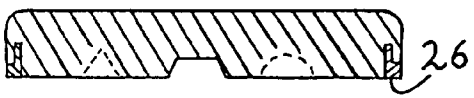
Figure 15:
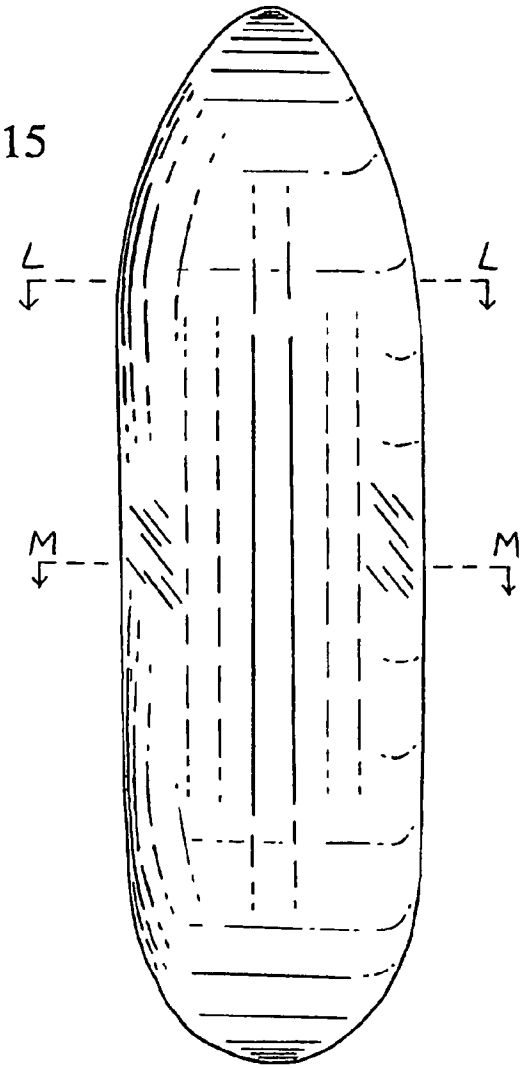
Figure 16A:
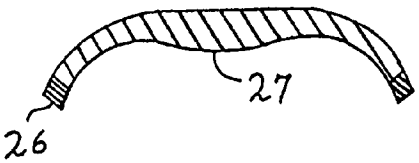
Figure 16B:
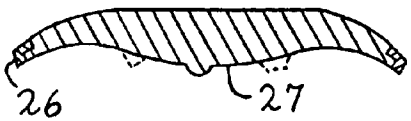
Figure 16C:
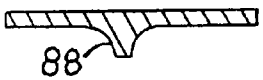
Figure 16:
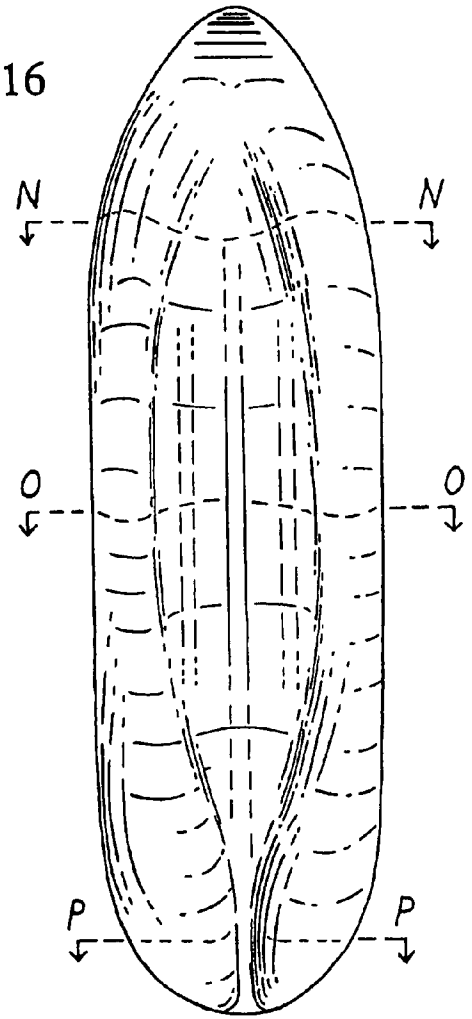
Figure 17A:
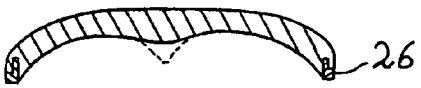
Figure 17B:
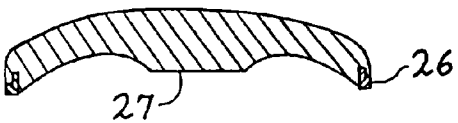
Figure 17C:
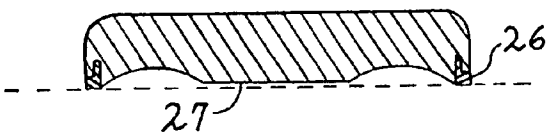
Figure 17:
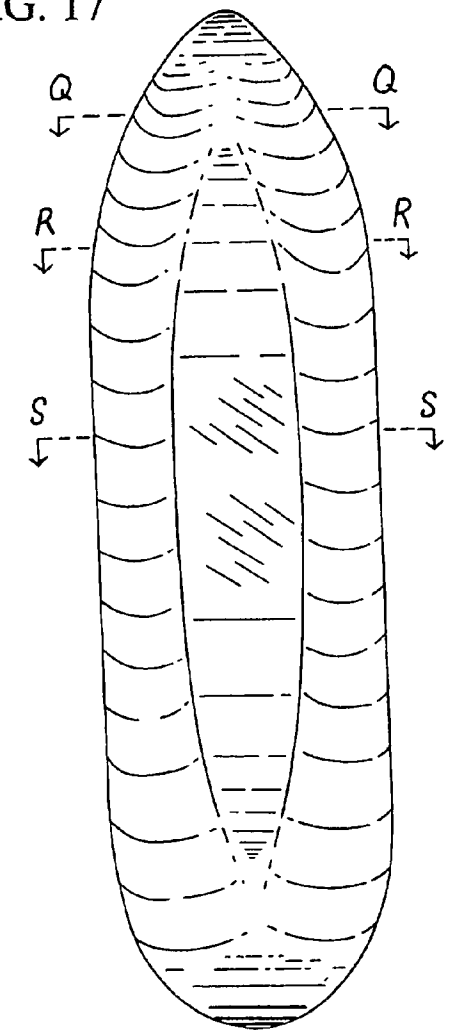
Figure 18:
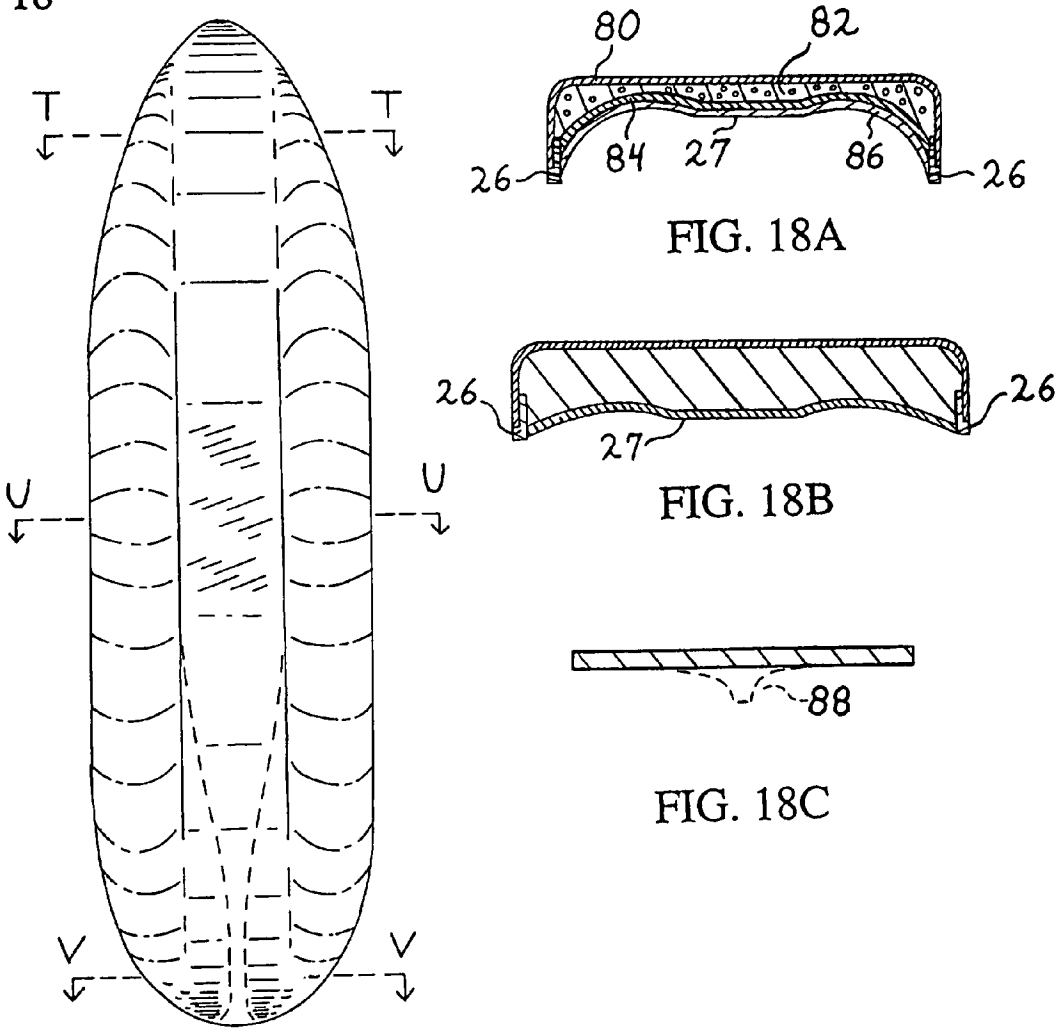
Figures 19, 19A, 19B, 19C, 19D:
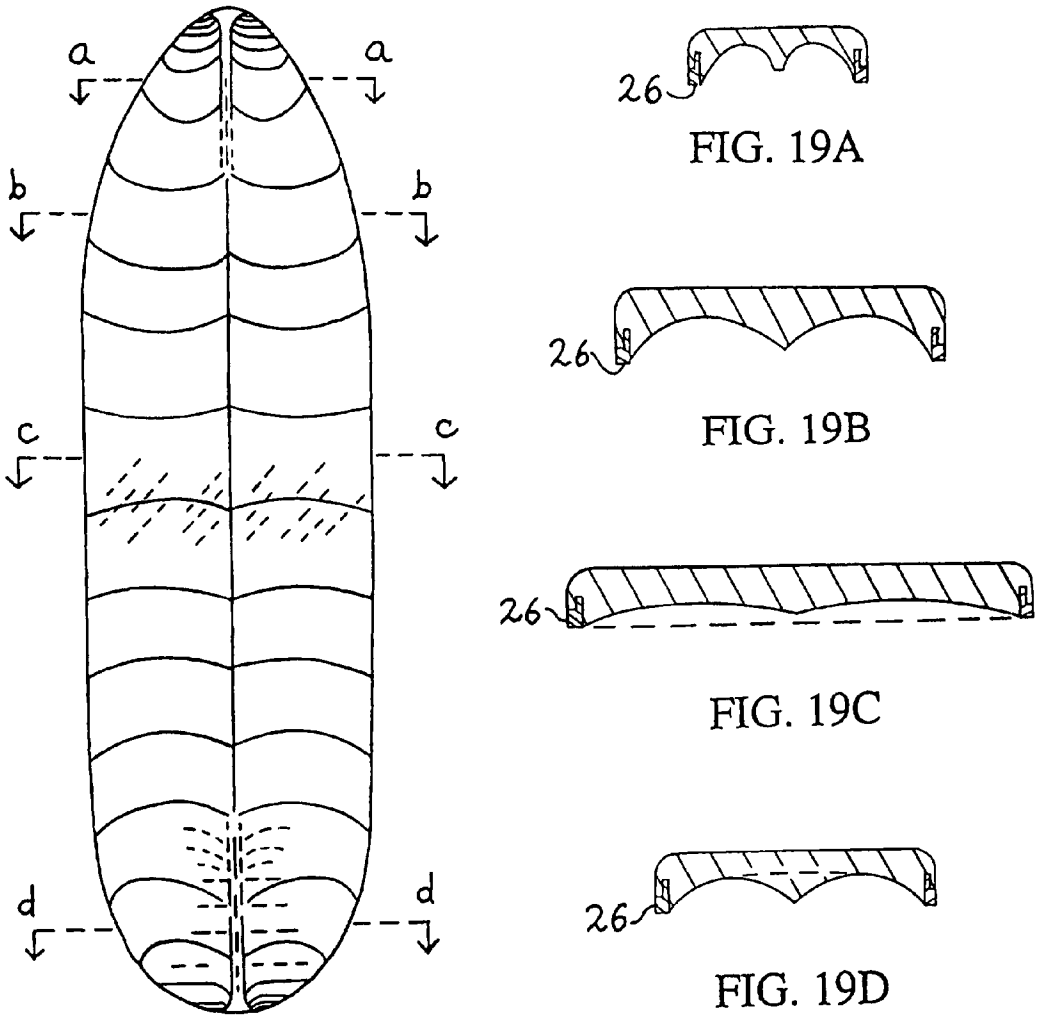
Figure 20A:
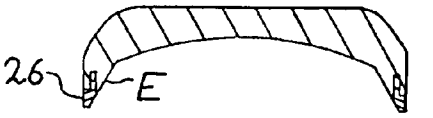
Figure 20B:
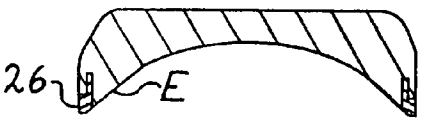
Figure 20C:
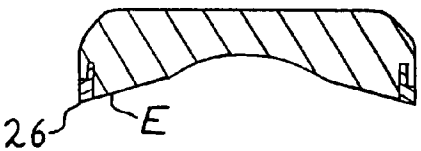
Figure 20D:
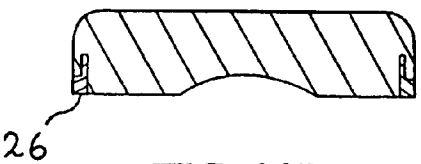
Figure 20:
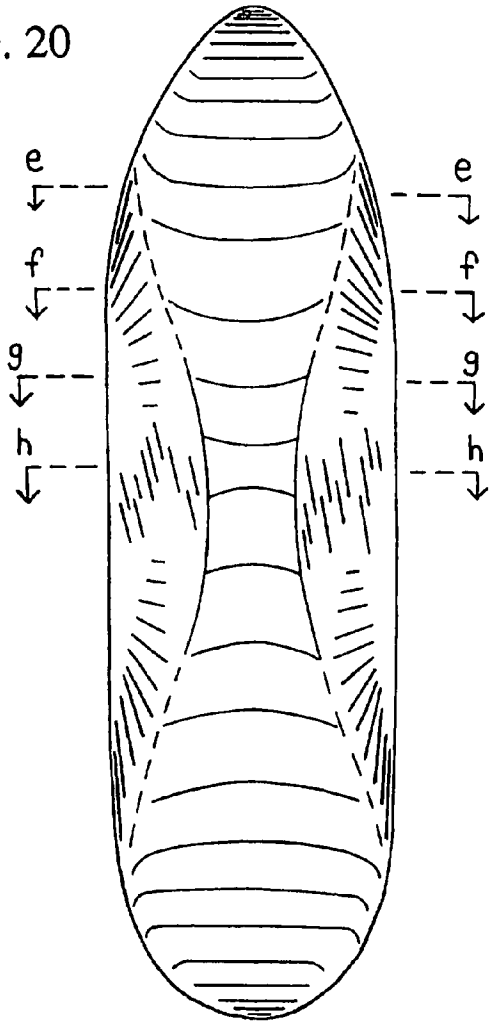
Figure 21A:
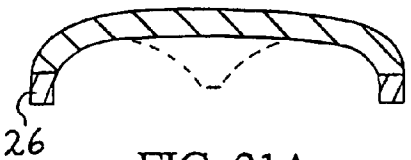
Figure 21B:
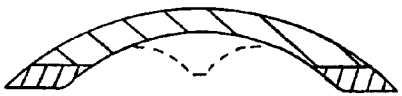
Figure 21C:
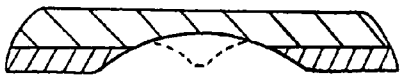
Figure 21D:
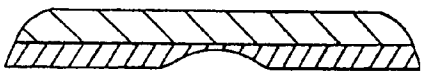
Figure 21:
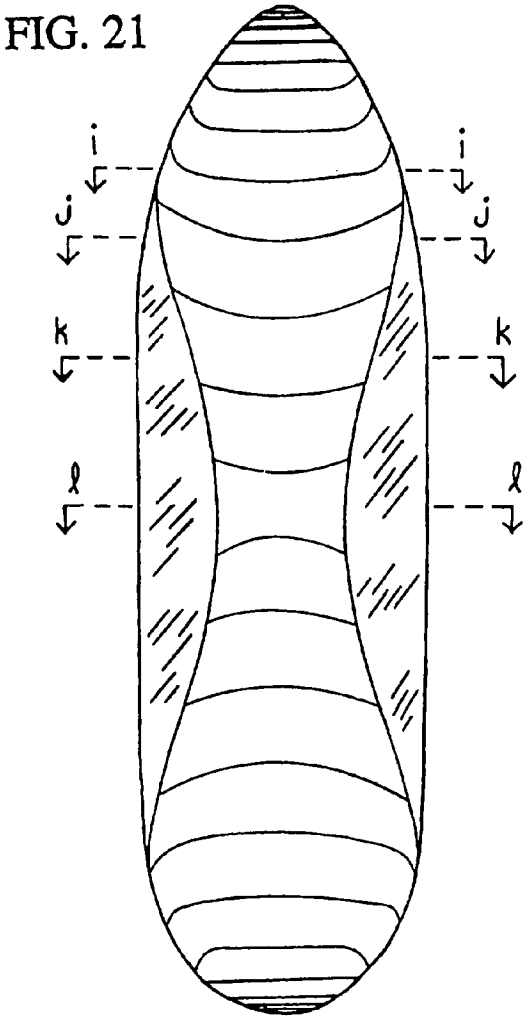
Figure 22A:
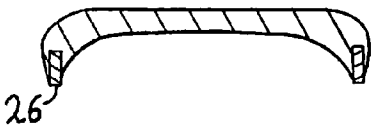
Figure 22B:
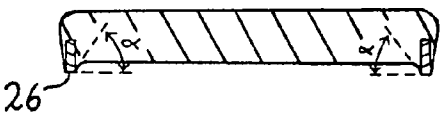
Figure 22C:
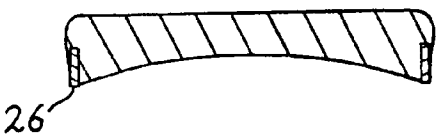
Figure 22:
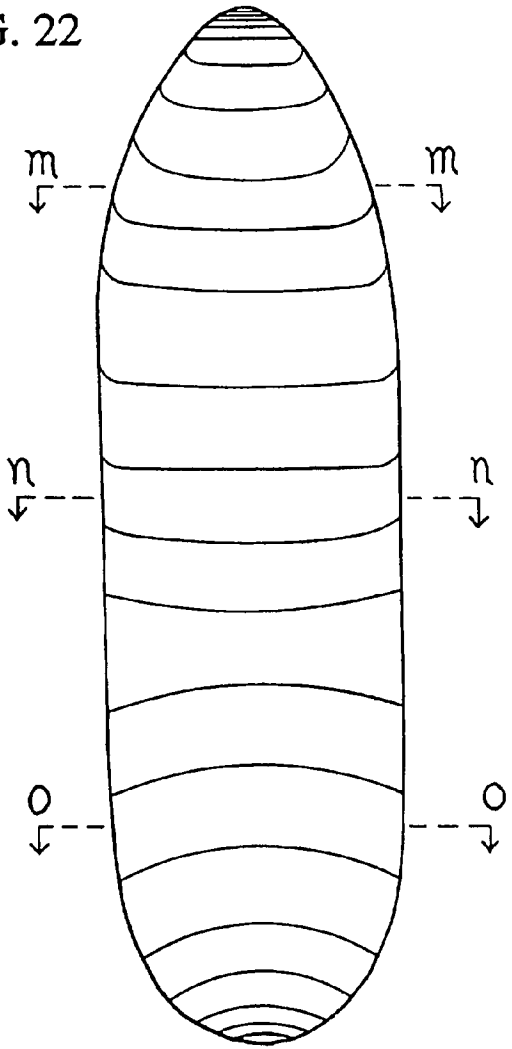
Figure 24:
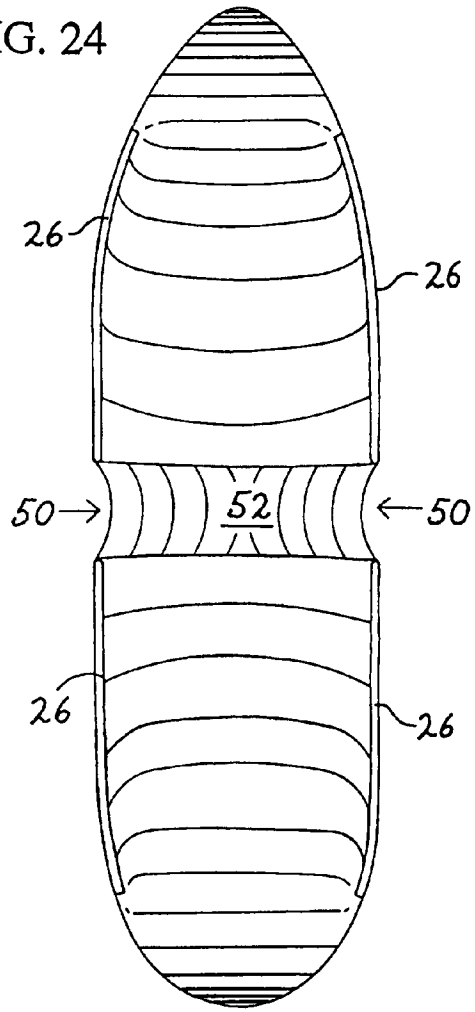
FIGS. 23 and 24 are bottom views of alternate embodiments of the invention.
Figure 23:
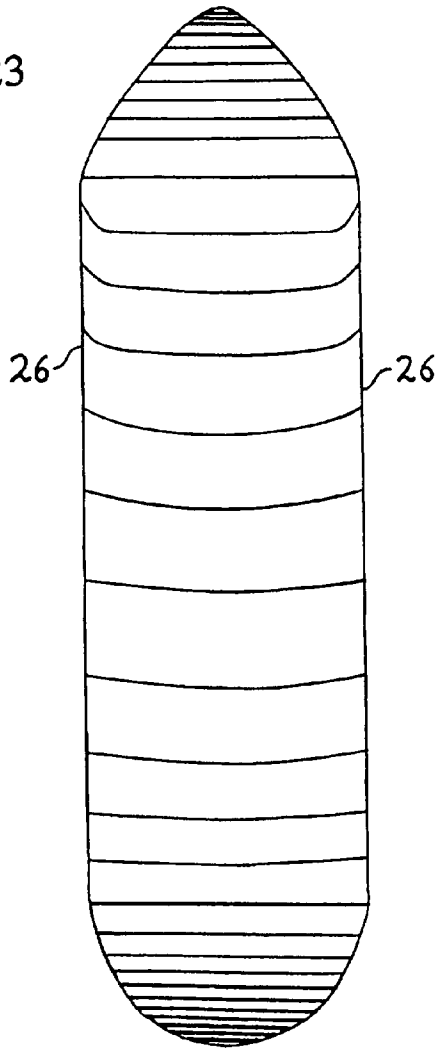

FIGS. 14 through 24 show alternative profiles for base 24 in bottom views and cross-sections. FIG. 14A is a cross-section along lines J-J of FIG. 14, and FIG. 14B shows five different cross-sections along lines K-K of FIG. 14, wherein steps or slots are provided to enhance tracking. FIG. 14A shows a wood core central section 77 in combination with a fiber composite sidewall 79. In FIG. 15, two possible cross-sections along lines L-L are shown in FIG. 15A, showing single-step and double-stepped edges and FIG. 15B shows a central groove or multiple grooves in the flat zone taken in cross-section along line M-M. In FIG. 16, the cross-section along lines N-N is shown in FIG. 16A, the cross-section along lines O-O is shown in FIG. 16B, which has a central convexity and bead or multiple tracking beads, and the cross-section along lines P-P is shown in FIG. 16C whereby a keel can be developed from diminishing central convexity. In FIG. 17, the cross-section along lines Q-Q is shown in FIG. 17A, the cross-section along lines R-R is shown in FIG. 17B, and the cross-section along lines S-S is shown in FIG. 17C, whereby a central planar area 27 in the flat zone diminishes to provide the increased concavity and projection of the edges 26 in the forward direction. The dotted lines in FIG. 17A show a central keel which may be included. In FIG. 18, the cross-section along lines T-T is shown in FIG. 18A, the cross-section along lines U-U is shown in FIG. 18B, and the cross-section along lines V-V is shown in FIG. 18C, whereby a central flat runner 27 diminishes in width to provide a rear keel 88 for tracking and extra bite. FIG. 18A shows a top structural sheet 80, honeycomb core 82, base structural sheet 84, P-tex base 86 and edge 26. In FIG. 19, the cross-section along lines a-a is shown in FIG. 19A, the cross-section along lines b-b is shown in FIG. 19B, the cross-section along lines c-c is shown in FIG. 19C, and the cross-section along lines d-d is shown in FIG. 19D, whereby a central V-shaped runner diminishes in significance towards the front and rear, as a narrowing keel. In FIG. 20, the cross-section along lines e-e is shown in FIG. 20A, the cross-section along lines f-f is shown in FIG. 20B, the cross-section along lines g-g is shown in FIG. 20C, and the cross-section along lines h-h is shown in FIG. 20D, wherein a deeply relieved front and rear concavity becomes confined as a shallower, narrower central trough through the flat zone. In FIG. 21, the cross-section along lines i-i is shown in FIG. 21A, the cross-section along lines j-j is shown in FIG. 21B, the cross-section along lines k-k is shown in FIG. 21C, and the cross-section along lines I-I is shown in FIG. 21D, wherein the side edges 26 develop into a base surface and a deeply relieved front and rear concavity becomes confined as a shallower, narrow central trough through the flat zone. The dotted lines show an alternative base configuration. In FIG. 22, the cross-section along lines m-m is shown in FIG. 22A, the cross-section along lines n-n is shown in FIG. 22B, and the cross-section along lines o-o is shown in FIG. 22C, which illustrates how the slope E in the flat zone immediately adjacent the edges 26 may be great in some embodiments where the edges in that region project only slightly from base 24, and also shows a lesser degree of edge prominence and transverse concavity in the rear bite zone than in the forward bite zone. FIG. 23 illustrates an embodiment having straight parallel edges 26 with no convergence at the front tip. FIG. 24 illustrates a discontinuity 50 in side edges 26 and concavity 52 which acts as a grind-plate to permit "skaters" to balance and slide sideways while riding along a rail or paired rail as provided in terrain parks.

The snow skate ski 12 of the invention can be manufactured using modified existing snowboard/ski manufacturing methods and materials. For use on ski hills, it may be preferable to produce the snow skate as a steel-edged, strong, lightweight construction able to mount to most snowboard bindings. Steam-bent, laminated wood strips (e.g., ash), drilled to accept stainless steel T-nut snowboard binding inserts in the standard 4×4 cm pattern, can be used to make the core of the snow skate; this can then be milled to shape for fixing/bonding the carbon steel edge strips, the core then covered/wrapped by reinforcing fiberglass cloth layers in an epoxy resin matrix; a protective cosmetic top sheet and a low-friction base surface layer. Manufacturing processes such as matched die heat/compression molding, or resin transfer molding may be used; synthetic fiber (e.g., fiberglass; carbon fiber; Kevlar™) cloth and epoxy, or epoxy pre-preg layers, can be used in the lay-up over a central core of laminated wood strips or a honeycomb material as in a structural sandwich construction; a molded rim construction, involving injecting a suitable synthetic resin around a wood core, may also be used as illustrated in FIG. 14A; an exothermically expanded foaming synthetic resin such as polyurethane, possibly strengthened by internal wood or other synthetic stringers centrally, can also provide the stiff central core of the snow skate encased by the reinforcing sheet layers, as with a modified cap construction; the laminate may further comprise an elastomer-layer, a layer(s) of spring steel or titanium or other suitable metal or alloy; and other advanced composites and engineered polymeric thermoset or thermoplastic resins could as well be used to make up ski 12, in whole or in part (see FIG. 14A). A drilled or punched reinforcing sheet or plate of a suitable rigid material, to receive the T-nut inserts and further prevent them from being ripped out under stress, can also be added during the lay-up. Among others known in the art, some suitable low-friction base surface materials, finishes, or treatments for the snow skate are: Ultra High Molecular Weight Polyethylene (UHMWPE); sintered P-Tex™; heat-melted fusable powdered polyethylene; polyurethane; ABS. A suitable thermoplastic (e.g., polyethylene; ABS) or fiber-reinforced thermoplastic or alloy may rather be used via extrusion blow molding or injection molding as for making a child's version of the snow skate, or otherwise for a version intended for use on snowy ground apart from ski hills; attached plastic ratchet-type buckles or nylon strap/Velcro™ bindings can be used for such a toy model of ski 12 with a suitable heel stop on the top surface of ski for securing binding around the ankle. The snow skates should be stiff centrally, yet become slightly flexible forward of the balls of feet (and back of heels) to gain a mechanical advantage of spring/recoil when pushing off the bite zone forwardly on the snowy ground in skating, and for shock absorption while in motion and during hard braking. Flex characteristics can be effected by making the snow skate thicker centrally and thinner towards the front and rear shovel portions, as for a structural sandwich construction having a core of diminishing thickness towards the ends of the laminate; shock absorption can be furthered by the use of elastomeric sheet layers in the construction of ski 12. While the down turned slope region E of the bite zone(s) inherently stiffens the structure, the use of more pliant laminates or materials laterally (see FIG. 14A), and the use of segmented edge strips, can better allow ski 12 to flex slightly towards the front and rear of the snow skate. A slight rocker is desirable over the length of the snow skate from the bite zone(s) towards the flat zone.

In another embodiment, the snow skates could be made using two sheets of steel or other suitable metal (e.g., aluminum; titanium) or alloy stamped out or otherwise formed to shape, or advanced composite pre-pregs or fiber-reinforced thermoplastic sheets or another suitably formable sheet material could be heat/compression molded or vacuum molded to form the top and base surfaces; the top and bottom surfaces can then be welded, tightly bonded, or otherwise fastened together to form the ski 12 of the invention. Exothermically expanded polyurethane foam/a foaming synthetic resin can be injected, or a similarly suitable core filler can be used, to solidify the gaps between the flat upper surface and the complex curvature of the base surface sheet or otherwise between the laminated layers of the construction. A drilled or punched reinforcing sheet or plate of a suitable rigid material, to receive the T-nut inserts and further prevent them from being ripped out under stress, can also be added during the construction.

In another embodiment, a single structural sheet of steel or other suitable material can be stamp-molded, or otherwise shaped to form the increasingly narrow and exposed and vertical side edges fore and rearward of the central flat zone. Once the stainless steel T-nut inserts for mounting snowboard bindings are in place in drilled/punched holes of the sheet, a molded base surface of suitable thermoplastic/thermoset material can be joined to the sheet so as to form the base surface shape, and then covered with, or else already having, a suitable ultra low-friction base surface for sliding; or a resilient, hard material can be joined to the sheet to develop the base to edge transition, as shown in FIG. 21. In another embodiment, a sheet of structural steel or other suitable rigid material can be stamped or molded to form the shape of the base surface and side edge profile, then a top sheet or layer of suitable material can be fixed to it overtop the positioned threaded T-nut binding inserts 28, so as to provide a smooth, even top surface for the snow skates. In yet another embodiment, a single sheet of steel or other metal or alloy, or a similarly suitable material layer, can be formed to make up the general shape of the snow skate; exposed at the down turned side edges, the steel sheet can be embedded in a suitable polymeric plastic molded around it to provide the top and the specific base contour of ski 12 (see FIG. 14B), having had the T-nut inserts positioned in holes made in the sheet prior to the molding operation. Ski 12 could also be fashioned from a single piece of spring steel, or other suitable metal or alloy, having drilled and tapped holes to receive a boot binding, and having a low friction surface treatment, layer, or coating applied to the base of the snow skate, and a cosmetic finish layer, coating, or treatment applied to the top of the ski.

In further embodiments, a simple rockered base, which is generally flat (and may be slightly concave) from side to side, can be given the varying degree of edge projection necessary for the invention by varying the width of the mounted side edges; or varying the mounting position of an edge strip of a given width; or varying the angle at which the side edge strips are mounted; or the snow skates' thickness can be varied using side edge strips of a given width to achieve the edge prominence required for varying degrees of bite into the snow; or a combination of the above. Such side edge strips can further vary in the angle at which they are mounted in the bite zone, from a vertical orientation down to 45 degrees, and still provide adequate bite into the snow to thereby provide the required degree of vertical edge penetration into the snowy ground, relative to the resting base surface contour along the length of the skate, to perform as desired by the user.

The vertical or otherwise inclined steel edges may be screwed, laminated, or tightly bonded to the snow skates, or joined as an insert during an exothermic thermoset/advanced composites/engineered resin molding process. The edges could also be suitably made from inset, resilient, hardened material forming the side walls 22 and/or running edges of the base surface (shown in FIG. 21); the inset material being capable of being sharpened and holding an edge, for example Nylon or Polycarbonate plastic [Delrin™]. The steel edges 26 should preferably approach being level with the bottom of base 24 at the flat zone, or project slightly below the level of base 24 to give a generally slightly concave or concave-convex-concave base surface in cross-section at the middle of the flat zone.

Thus concentrating the weight of the user more towards the central flat zone of the base permits side slippage, pivoting, spinning or turning backwards. Concentrating the weight of the user on the front (or rear) bite zones allows the user to carve turns, brake, stop or perform a skating motion in which the user alternately forces off the inside edge of each ski in the area of the bite zone to obtain acceleration. Stopping can be achieved either using a sideways hockey stop or snowplow motion while going forwards or a reverse snowplow going backwards.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

As will be apparent to those skilled in the art in the light of the foregoing disclosure, many alterations and modifications are possible in the practice of this invention without departing from the spirit or scope thereof. For example, features of specific variants shown in the drawings may be combined with specific features of other variants to produce a snow skate with the desired combination of side slipping and biting characteristics. Accordingly, the scope of the invention is to be construed in accordance with the substance defined by the following claims.

What is claimed is:

1. A snow skate, comprising an elongated ski body having an upturned front end and a rear end, said ski body comprising:

a) an upper surface adapted to receive a boot binding for releasably securing a boot to said upper surface intermediate said front and rear ends;

b) a base surface having a central generally flat zone and a first zone of increased edge projection forward of said flat zone; and c) longitudinal edges extending along opposed sides of said base surface;

wherein the depth of said edges below said base increases continuously from said flat zone towards said zone of increased edge projection forward of said flat zone wherein said base surface further comprises a second zone of increased edge projection rearward of said flat zone and the depth of said edges below said base increases continuously from said flat zone towards said second zone of increased edge projection.

2. A snow skate, comprising an elongated ski body having an upturned front end and a rear end, said ski body comprising:

a) an upper surface adapted to receive a boot binding for releasably securing a boot to said upper surface intermediate said front and rear ends;

b) a base surface having a central generally flat zone and a first zone of increased edge projection forward of said flat zone; and c) longitudinal edges extending along opposed sides of said base surface;

wherein the transverse concavity of said base increases continuously from said flat zone towards said zone of increased edge projection wherein said base surface further comprises a second zone of increased edge projection rearward of said flat zone and the transverse concavity of said base increases continuously from said flat zone towards said second zone of increased edge projection.

3. The snow skate of claim 1 or 2 wherein said base surface is slightly concave in transverse cross-section in said flat zone.

4. The snow skate of claim 1 or 2 wherein said edges project slightly below said base surface in transverse cross-section in said flat zone.

5. The snow skate of claim 1 or 2 wherein said edges have a rocker curvature longitudinally.

6. The snow skate of claim 1 or 2 wherein said base surface has a central convex ridge running longitudinally through said flat zone.

7. The snow skate of claim 1 wherein said first zone of increased edge projection lies generally below the ball of a user's foot when the snow skate is in use.

8. The snow skate of claim 1 wherein the length of said ski body is not significantly greater than the length of the user's boot.

9. The snow skate of claim 1 wherein said rear end is upturned.

10. The snow skate of claim 1 wherein said base comprises a transverse passage sized and shaped to receive the surface of a cylindrical railing.

11. The snow skate of claim 1 comprising a snowboard binding secured thereto.

12. The snow skate of claim 1 wherein the depth of said edges below said base in said second zone of increased edge projection rearward of said flat zone is less than the depth of said edges below said base in said first zone of increased edge projection.

13. The snow skate of claim 2 wherein said second zone of increased edge projection lies generally below the heel of a user's foot when the snow skate is in use.

14. The snow skate of claim 2 wherein the transverse concavity in said second zone of increased edge projection rearward of said flat zone is less than the transverse concavity in said first zone of increased edge projection.

15. A snow skate, comprising an elongated ski body having an upturned front end and a rear end, said ski body comprising:

a) an upper surface adapted to receive a boot binding for releasably securing a boot to said upper surface intermediate said front and rear ends;

b) a base surface having a central generally flat zone and a zone of increasing edge projection forward of said flat zone; and c) longitudinal edges extending along opposed sides of said base surface;

wherein the depth of said edges below said base increases continuously in a forward direction in said zone of increasing edge projection forward of said flat zone and wherein a tangential angle is formed at a selected distance forward of said flat zone by said base surface with a transverse horizontal line extending between corresponding lowermost points on said opposed longitudinal edges at said selected distance forward of said flat zone and wherein said tangential angle formed by said base surface with said horizontal line in a region adjacent said longitudinal edges increases within said zone of increasing edge projection forward of said flat zone to greater than 45 degrees.

16. The snow skate of claim 15 wherein the length of said ski body is not significantly greater than the length of the user's boot.

17. The snow skate of claim 15 further comprising a snowboard binding secured thereto.

18. The snow skate of claim 15 wherein said tangential angle formed by said base surface with said horizontal line in a region adjacent said longitudinal edges increases within said zone of increasing edge projection forward of said flat zone to greater than 60 degrees.

19. A snow skate, comprising an elongated ski body having an upturned front end and a rear end, said ski body comprising:

a) an upper surface adapted to receive a boot binding for releasably securing a boot to said upper surface intermediate said front and rear ends;

b) a base surface having a central generally flat zone and a transversely concave zone of increasing edge projection forward of said flat zone thereby forming a transverse concavity in said base surface forward of said flat zone; and c) longitudinal edges extending along opposed sides of said base surface;

wherein the transverse concavity of said base surface forward of said flat zone increases continuously in a forward direction in said zone of increasing edge projection forward of said flat zone and wherein a tangential angle is formed at a selected distance forward of said flat zone by said base surface with a transverse horizontal line extending between corresponding lowermost points on said opposed longitudinal edges at said selected distance forward of said flat zone and wherein said tangential angle formed by said base surface with said horizontal line in a region adjacent said longitudinal edges increases within said zone of increasing edge projection forward of said flat zone to greater than 45 degrees.

20. The snow skate of claim 19 wherein the length of said ski body is not significantly greater than the length of the user's boot.

21. The snow skate of claim 19 further comprising a snowboard binding secured thereto.

22. The snow skate of claim 19 wherein said tangential angle formed by said base surface with said horizontal line in a region adjacent said longitudinal edges increases within said zone of increasing edge projection forward of said flat zone to greater than 60 degrees.

* * * * *

UNITED STATES PATENT AND TRADEMARK OFFICE

CERTIFICATE OF CORRECTION

PATENT NO. : 7,510,206 B2
APPLICATION NO. : 10/514101
DATED : March 31, 2009
INVENTOR(S) : Curtis G. Walker It is certified that error appears in the above-identified patent and that said Letters Patent is hereby corrected as shown below:

Title Page,
Item [76], the applicant has since moved. Please replace "5505 Cliffridge Place, North Vancouver, B.C. (CA) V7R 4S2" with -- P.O. Box 10180, 108 Mile Ranch, B.C. (CA) V0K 2Z0 --.

Column 3,
Line 10, change "ski 10" to -- ski 12 --;
Line 16, replace "25 inches. It" by -- 63cm (25 inches). Ski 12 --;
Line 17, after "that", insert -- when mounted, --;
Line 23, change "FIG. 4." to -- FIG. 5. --;
Line 29, change "ski 10." to -- ski 12. --;
Line 41, replace "convexity" by -- generally convex ridge --;
Line 47, change "FIG." to -- FIGS. --;
Lines 54-55, delete "or slide lip";
Line 57, after "over", insert -- the --;
Line 65, after "base", insert -- 24 and --;

Column 4,
Line 22, replace "overlaps the bite zone B" by -- verges on the bite zone B. --;
Line 23, delete "and";
Line 29, delete "25 or";
Line 36, insert a comma after "Similarly";

Column 5,
Line 3, change "FIGS. 12B and 12C" to -- FIGS. 12C and 12B --;
Line 5, replace "increasing angle of slope E and projection" by -- increasing concavity and angle of slope E and increasing projection --;
Line 11, after "concavity", insert -- and angle of slope E --;
Line 18, change "FIGS. 13B-13E" to -- FIGS. 13B-13D --;
Line 20, after "depth", insert -- Z --;
Line 36, after the word "in", insert -- base --;
Line 38, after "base", insert -- 24 of ski 12 --;
Line 47, before "slots", insert -- troughs or --;
Line 51, after "edges", insert -- 26 --;
Line 53, change "line" to -- lines --;
Line 55, after "convexity", insert -- 27 --;
Line 57, after "keel", insert -- 88 --;

UNITED STATES PATENT AND TRADEMARK OFFICE

CERTIFICATE OF CORRECTION

PATENT NO. : 7,510,206 B2
APPLICATION NO. : 10/514101
DATED : March 31, 2009
INVENTOR(S) : Curtis G. Walker It is certified that error appears in the above-identified patent and that said Letters Patent is hereby corrected as shown below:

Line 58, after "from", insert -- a --;
Line 64, after the period following "direction", insert the clarifying sentence:
-- FIG. 17C also illustrates only edges 26 contact a hard icy surface (shown as the dashed line) in the flat zone of this embodiment. --;
Line 65, replace "included." by -- included for extra bite. --;

Column 6,
Lines 2-3, replace "diminishes" by -- can diminish --, and delete "for tracking and extra bite";
Line 5, replace "edge" by -- steel edges --;
Lines 9-10, replace "diminishes in significance towards the front and rear, as a narrowing keel." by -- contracts as a narrowing keel towards the front and rear. --;
Line 20, change "I-I" to -- l-l --;
Line 23, change "narrow" to -- narrower --;
Line 28, replace "slope E" by -- angle of slope E --;
Line 32, after "concavity", insert -- developed --;
Line 35, replace "concavity 52" by -- transverse passage/concavity 52 --;
Line 37, replace "while riding along a rail or paired rail" by -- steadily while riding along a rail or pipe --;
Line 47, replace "snow skate" by -- ski 12 --;
Line 51, replace "layer." by -- layer may be included in the lay-up. --;
Line 57, replace "construction; a" by -- construction (see FIG. 18A); a --.

UNITED STATES PATENT AND TRADEMARK OFFICE

CERTIFICATE OF CORRECTION

PATENT NO. : 7,510,206 B2
APPLICATION NO. : 10/514101
DATED : March 31, 2009
INVENTOR(S) : Curtis G. Walker It is certified that error appears in the above-identified patent and that said Letters Patent is hereby corrected as shown below:

Column 7,
Line 56, before "increasingly", insert -- top surface and the --;
Line 62, replace "shape, and" by -- shape of ski 12 (see FIG. 14B), and --.

Column 8,
Line 4, replace "skates." by -- skates (see FIG. 14B). --;
Line 50, replace "backwards." by -- backwards at speed. --;
Line 52, after "stop", insert -- , --.

Signed and Sealed this

Twentieth Day of October, 2009

David J. Kappos

David J. Kappos
*Director of the United States Patent and Trademark Office*